US010711423B2

(12) United States Patent
Hu et al.

(10) Patent No.: US 10,711,423 B2
(45) Date of Patent: Jul. 14, 2020

(54) STRUCTURAL STEEL INNER SUPPORT SYSTEM IN FOUNDATION PIT

(71) Applicant: Dongtong Geotechnical Science and Technology Inc., Hangzhou, Zhejiang (CN)

(72) Inventors: Qi Hu, Zhejiang (CN); Huan Hu, Zhejiang (CN); Haidi Zhu, Zhejiang (CN); Xingdi Huang, Zhejiang (CN)

(73) Assignee: Dongtong Geotechnical Science and Technology Inc., Hangzhou (CN)

( * ) Notice: Subject to any disclaimer, the term of this patent is extended or adjusted under 35 U.S.C. 154(b) by 0 days.

(21) Appl. No.: 16/104,885

(22) Filed: Aug. 18, 2018

(65) Prior Publication Data

US 2019/0153693 A1 May 23, 2019

(30) Foreign Application Priority Data

Nov. 22, 2017 (CN) ..... 2017 1 1175247

(51) Int. Cl.
*E02D 17/04* (2006.01)

(52) U.S. Cl.
CPC ..... *E02D 17/04* (2013.01); *E02D 2300/0029* (2013.01)

(58) Field of Classification Search
CPC ..... E02D 17/04; E02D 17/08; E02D 17/083
See application file for complete search history.

(56) References Cited

FOREIGN PATENT DOCUMENTS

| | | | |
|---|---|---|---|
| CN | 105431593 A | | 3/2016 |
| JP | 59031316 | * | 2/1984 |
| JP | 2016528406 A | | 9/2016 |
| KR | 20130085430 A | | 7/2013 |
| WO | WO 2007/058464 | * | 5/2007 |
| WO | 2015009124 A | | 1/2015 |
| WO | WO 2015009126 | * | 1/2015 |

* cited by examiner

*Primary Examiner* — Sean D Andrish
(74) *Attorney, Agent, or Firm* — Wayne & Ken, LLC; Tony Hom

(57) ABSTRACT

The present invention discloses a structural steel inner support system in a foundation pit which ensures the support density of the structural steel inner support beam of the inner support system for foundation pits and improves structural stability and reliability of inner support of foundation pits. The system includes a purlin assembly, a plurality of vertical force-guiding connecting members including support members, upper force-guiding connecting beams and lower force-guiding connecting beams in the foundation pit; and a structural steel inner support beam and a prestress-pressing member in the foundation pit.

6 Claims, 3 Drawing Sheets

STRUCTURAL STEEL INNER SUPPORT SYSTEM IN FOUNDATION PIT

CROSS-REFERENCE TO RELATED APPLICATIONS

This application claims priority to Chinese application no. 201711175247.7 with a filing date of Nov. 22, 2017. The content of the aforementioned application, including any intervening amendments thereto, are incorporated herein by reference.

TECHNICAL FIELD

The present invention relates to a support structure of a foundation pit, and more specifically to a structural steel inner support system in a foundation pit.

BACKGROUND

To ensure the safety of underground structures and surrounding environment of foundation pits, it is necessary to adopt protective measures such as support and reinforcement on the side wall and surrounding of foundation pits. The current support system for foundation pits generally includes an enclosing pile arranged around the edge of a foundation pit, a purlin arranged inside an enclosing pile of a foundation pit, and an inner support of a foundation pit arranged between the purlins. The inner support of a foundation pit usually includes a structural steel inner support beam supported by a prestress-pressing member arranged between the purlins, and the structural steel inner support beam pre-stresses on the prestress-pressing member through a hydraulic jack to support purlins on the opposite sides. Therefore the support for a foundation pit is formed to ensure the support strength of the support system for a foundation pit.

At present, end portions of structural steel inner support beams in the inner support system for foundation pits directly abut on the inner side of purlins, or through prestress-pressing members or through triangular members. The current inner support for foundation pits is a plane support structure with poor structural stability, therefore being not conducive to ensuring the support strength of the support system for foundation pits.

On the other hand, although structural steel inner support beams can support foundation pits, the present structural steel inner support beams in foundation pits are independent of each other, thereby affecting the overall stability of inner support of foundation pits, and further affecting the stability of inner support of foundation pits for support of foundation pits. Further, in order to improve the overall stability of inner support of foundation pits, the inventor arranges a tie beam between the adjacent structural steel inner support beams, wherein the tie beam and structural steel inner support beams are fixedly connected by bolts or welding. It seems to improve the overall stability of inner support of foundation pits, in the actual application process, however, it is found that the connecting beam is susceptible to shear failure. The connection between structural steel inner support beams cannot be formed by the tie beam and the overall stability of inner support of foundation pits cannot be improved.

SUMMARY

The first object of the present invention is to provide a structural steel inner support system in a foundation pit which ensures the support density of the structural steel inner support beam of the inner support system for foundation pits and improves structural stability and reliability of inner support for foundation pits and thereby improving the stability of inner support of foundation pits for support of foundation pits.

Based on the first object, another object of the present invention is to provide a structural steel inner support system in a foundation pit which improves the overall stability of the inner support of foundation pits and avoids shear failure of tie beams and thereby improving the stability of inner support of foundation pits for support of foundation pits.

Technical Solutions Provided by the Present Invention

The structural steel inner support system in a foundation pit includes a purlin assembly, wherein one purlin assembly includes an upper purlin and a lower purlin arranged at inner side of an enclosing pile of the foundation pit; a plurality of vertical force-guiding connecting members connecting the upper purlin to the lower purlin; wherein each of the vertical force-guiding connecting member comprises a support member, an upper force-guiding connecting beam and a lower force-guiding connecting beam arranged below the upper force-guiding connecting beam in the foundation pit; one end of the upper force-guiding connecting beam is connected to the support member and the other end extends obliquely upward to a direction of the upper purlin and is connected to the upper purlin; one end of the lower force-guiding connecting beam is connected to the support member and the other end extends obliquely downward to a direction of the lower purlin and is connected to the lower purlin; a triangular support structure is formed by the support member, the upper force-guiding connecting beam and the lower force-guiding connecting beam together; and a structural steel inner support beam and a prestress-pressing member in the foundation pit; wherein one end of the structural steel inner support beam abuts against one support member with one vertical force-guiding connecting member and the other end of the structural steel inner support beam abuts against another support member of another vertical force-guiding connecting member through one prestress-pressing member; the prestress-pressing member includes two mutually openable support parts; wherein one support part abuts on the support member of the purlin; and the other support part is connected to an end portion of the structural steel inner support beam through bolts.

The structural steel inner support beam of inner support system for the foundation pit in the invention is supported on the upper purlin and the lower purlin through vertical force-guiding connecting members. A triangular support structure is formed by the support member, the upper force-guiding connecting beam and the lower force-guiding connecting beam of vertical force-guiding connecting member improving the overall stability of inner support of foundation pits. And at the meantime, since the upper force-guiding connecting beam and the lower force-guiding connecting beam of the vertical force-guiding connecting member are vertically distributed, the vertical force-guiding connecting member does not occupy the space of foundation pits horizontally, and thereby not affecting the support density of the structural steel inner support beam of the support system for foundation pits. Such distribution ensures the support density of the structural steel inner support beam of the support system for foundation pits while improving structural stability and reliability of inner support of foundation pits and the stability of inner support of foundation pits for support of foundation pits.

Preferably, an inclined angle of the upper force-guiding connecting beam is identical to an inclined angle of the lower force-guiding connecting beam.

Preferably, an inclined angle of the upper force-guiding connecting beam is greater than an inclined angle of the lower force-guiding connecting beam.

Conventionally, the inclined angle of the upper force-guiding connecting beam and the inclined angle of the lower force-guiding connecting beam are designed to be the same. However, the inventor of the present invention overcomes the prejudice of the prior art and designs the inclined angle of the upper force-guiding connecting beam to be greater than the inclined angle of the lower force-guiding connecting beam, thereby further improving the structural stability and reliability of the inner support of foundation pit. Since the foundation pit and the enclosing pile is a whole, during the process of the enclosing pile leaning inward, the higher the enclosing pile, the greater the displacement, and the greater the pressure acting on the inner support of the structural steel. Therefore, the pressure the enclosing pile acting on the upper force-guiding connecting beam will be greater than the pressure acting on the lower force-guiding connecting beam. Therefore, the inclined angle of the upper force-guiding connecting beam is designed to be greater than the inclined angle of the lower force-guiding connecting beam in the invention so that the direction of joint force of the pressure the enclosing pile acting on the upper force-guiding connecting beam and the lower force-guiding connecting beam is parallel to the structural steel inner support beam as much as possible, thereby further improving the support capacity and stability of the structural steel inner support beam for the foundation pit.

Preferably, the upper force-guiding connecting beam includes a plurality of upper H beams arranged side by side and a plurality of upper connecting beams connecting the upper H beams. The upper H beams are parallel to each other and one upper connecting beam is perpendicular to one upper H beam.

Preferably, the lower force-guiding connecting beam includes a plurality of lower H beams arranged side by side and a plurality of lower connecting beams connecting the lower H beams, wherein the lower H beams are parallel to each other, and one lower connecting beam is perpendicular to one lower H beam.

Preferably, a vertical connecting shaft rod is arranged between the upper force-guiding connecting beam and the lower force-guiding connecting beam.

Preferably, a plurality of structural steel inner support beams are provided in this invention. And a plurality of rotating connecting mechanisms are also arranged between the two adjacent structural steel inner support beams, wherein the rotating connecting mechanism includes a tie beam and two rotating mechanisms, and one rotating mechanism is arranged on a structural steel inner support beam and the other is arranged on another structural steel inner support beam. The rotating mechanism includes a support base arranged on the structural steel inner support beam, and a connecting base arranged on the support base through a vertical shaft rod. One end of the tie beam is connected to a connecting base of a rotating mechanism, and the other end of the connecting beam is connected to a connecting base of another rotating mechanism.

The tie beam in the invention is connected to the structural steel inner support beam through a rotating mechanism. And the rotating mechanism is arranged to make the tie beam a standard two-force member, so that the tie beam can improve the overall stability of the inner support of the foundation pit, and avoid shear failure of the tie beam, thereby improving the stability of the inner support of the foundation pit for the support of the foundation pit.

Preferably, in each of the rotating connecting mechanisms arranged between two adjacent structural steel inner support beams: the tie beams of the two adjacent rotating connecting mechanisms are arranged in a splayed shape. The structure of the invention is beneficial to improve the overall stability of inner support of a foundation pit.

Beneficial Effects of the Present Invention

Firstly, the support density of the structural steel inner support beam of the support system can be ensured and structural stability and reliability of inner support of foundation pits is improved, and the stability of inner support of foundation pits for foundation pit support is also improved.

Secondly, the overall stability of the inner support of foundation pits can be improved, and shear failure of tie beams can be avoided, thereby improving the stability of inner support of foundation pits for foundation pit support.

1. enclosing pile; 2. purlin assembly; 2.1 upper purlin; 2.2 lower purlin; 3. vertical force-guiding connecting member; 3.1 support member; 3.2 upper force-guiding connecting beam; 3.21 upper H beam; 3.22 upper connecting beam; 3.3 lower force-guiding connecting beam; 3.31 lower H beam; 3.32 lower connecting beam; 4. prestress-pressing member; 4.1 support component; 5. structural steel inner support beam; 6. rotating connecting mechanism; 6.1 rotating mechanism; 6.11 support base; 6.12 vertical shaft rod; 6.13 connecting base; 6.2 tie beam.

DETAILED DESCRIPTION

The present invention will be further described in detail below with reference to the drawings and specific embodiments.

Embodiment 1

Figure 1:
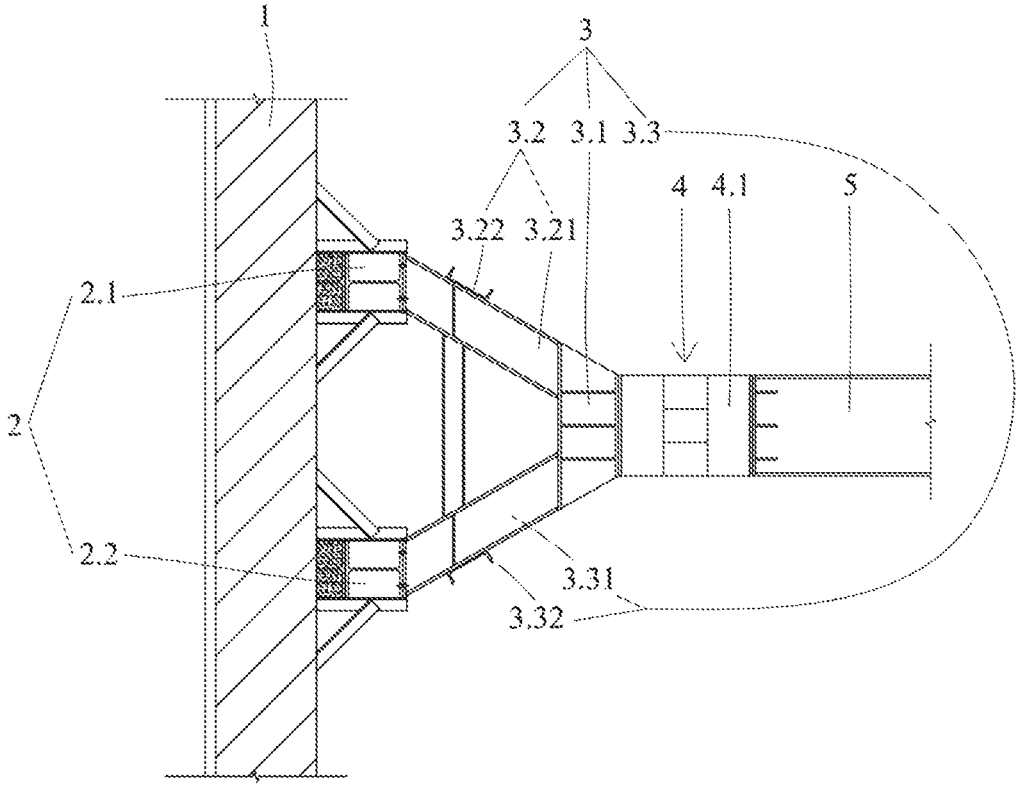
FIG. 1 is a structural schematic view of structural steel inner support system in a foundation pit according to embodiment 1 of the present invention.

As shown in FIG. 1, a structural steel inner support system in a foundation pit, includes a purlin assembly 2, a plurality of vertical force-guiding connecting members 3, and a structural steel inner support beam 5 and a prestress-pressing member 4 in a foundation pit.

The same purlin assembly includes an upper purlin 2.1 and a lower purlin 2.2 arranged inside an enclosing pile 1 of a foundation pit. The upper purlin is located above the lower purlin. The upper purlin is parallel to the lower purlin.

A vertical connecting member is arranged to connect the upper and lower purlins. The vertical connecting member includes a support member 3.1, an upper force-guiding connecting beam 3.2 and a lower force-guiding connecting beam 3.3 arranged below the upper force-guiding connecting beam 3.2 in the foundation pit. One end of the upper force-guiding connecting beam is connected to the support member, and the other end of the upper force-guiding connecting beam extends obliquely upward to a direction of the upper purlin and is connected to the upper purlin; one end of the lower force-guiding connecting beam is connected to the support member and the other end extends obliquely downward to a direction of the lower purlin and is connected to the lower purlin; a triangular support structure is formed by the support member, the upper force-guiding connecting beam and the lower force-guiding connecting beam together.

The inclined angle of the upper force-guiding connecting beam is identical to the inclined angle of the lower force-guiding connecting beam.

The upper force-guiding connecting beam includes a plurality of upper H beams arranged side by side and a plurality of upper connecting beams connecting the upper H beams. Each of the upper H beams is parallel to each other, and one upper connecting beam is perpendicular to one upper H beam. The lower force-guiding connecting beam includes a plurality of lower H beams arranged side by side and a plurality of lower connecting beams connecting the respective H beams. Each of the lower H beams is parallel to each other, and one lower connecting beam is perpendicular to one lower H beam. A vertical connecting shaft rod is arranged between the upper force-guiding connecting beam and the lower force-guiding connecting beam.

One end of the structural steel inner support beam abuts against the support member of one vertical force-guiding connecting member. The other end of structural steel inner support beam abuts against the support member of the other vertical force-guiding connecting member through a prestress-pressing member.

The prestress-pressing member includes two mutually openable support parts 4.1, wherein one support part abuts on the support member of the purlin, and the other support part is connected to the end portion of the structural steel inner support beam through bolts.

Embodiment 2

The remaining structure of this embodiment refers to Embodiment 1, and the difference is:

The inclined angle of the upper force-guiding connecting beam is greater than the inclined angle of the lower force-guiding connecting beam, and the difference between the inclined angle of the upper force-guiding connecting beam and the inclined angle of the lower force-guiding connecting beam is 5-10 degrees.

Embodiment 3

Figure 2:
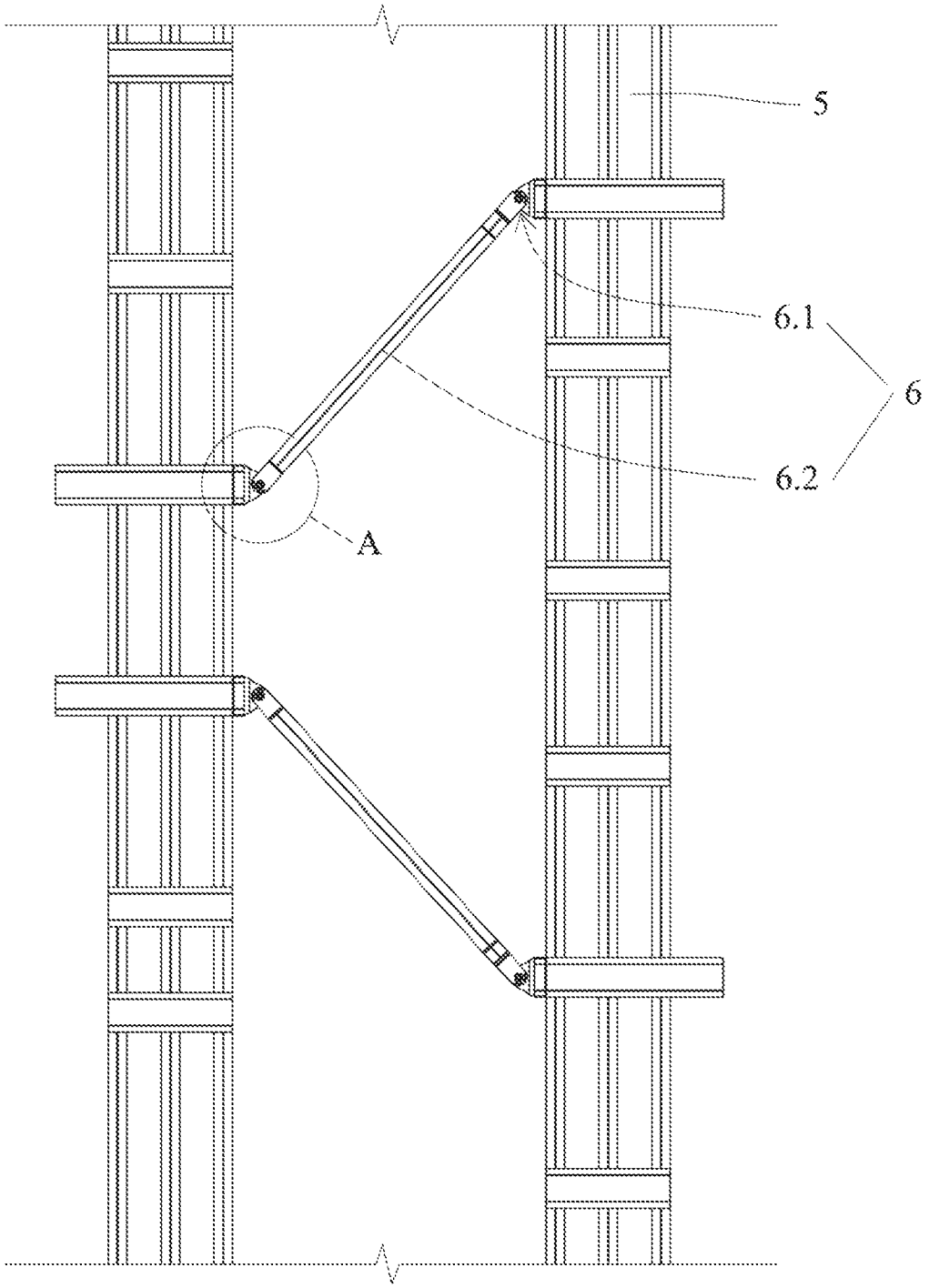
FIG. 2 is a partial structural schematic view of structural steel inner support system in a foundation pit according to embodiment 3 of the present invention.
Figure 3:
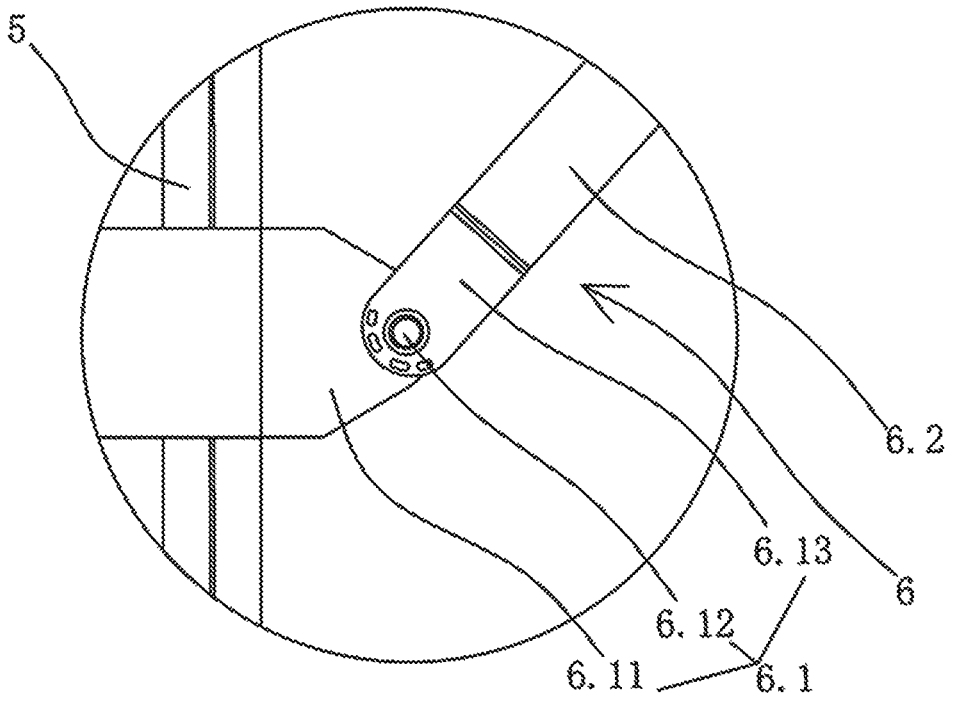
FIG. 3 is a partial enlargement view of A in FIG. 2.

The remaining structure of this embodiment refers to Embodiment 1, and the difference is:

As shown in FIG. 2 and FIG. 3, a plurality of structural steel inner support beams are provided in this embodiment. A plurality of rotating connecting mechanism 6 are also arranged between the two adjacent structural steel inner support beams.

The rotating connecting mechanism includes a tie beam 6.2 and two rotating mechanisms 6.1, one rotating mechanism is arranged on a structural steel inner support beam and the other is arranged on another structural steel inner support beam. The rotating mechanism includes a support base 6.11 arranged on a structural steel inner support beam, and a connecting base 6.13 arranged on the support base through the vertical shaft rod 6.12. The support base is connected to the structural steel inner support beam through bolts.

The tie beam is arranged horizontally. One end of the tie beam is connected to the connecting base of one rotating mechanism, and the other end of the tie beam is connected to the connecting base of the other rotating mechanism. The tie beam is connected to the connecting base through bolts. The angle between the tie beam and the structural steel inner support beam of the steel is 45 degrees.

In each of the rotating connecting mechanisms arranged between two adjacent structural steel inner support beams: the tie beams of the two adjacent rotating connecting mechanisms are arranged in a splayed shape.

What is claimed is:

1. A structural steel inner support system in a foundation pit, comprising:

a purlin assembly, wherein the purlin assembly comprises an upper purlin and a lower purlin arranged at an inner side of an enclosing pile of the foundation pit, wherein the enclosing pile is vertically disposed;

a plurality of vertical force-guiding connecting members connecting the upper purlin to the lower purlin; wherein each of the vertical force-guiding connecting members comprises a support member, an upper force-guiding connecting beam and a lower force-guiding connecting beam connected with the upper force-guiding connecting beam by the support member; one end of the upper force-guiding connecting beam is connected to the support member and the other end extends obliquely upward to a direction of the upper purlin and is connected to the upper purlin; one end of the lower force-guiding connecting beam is connected to the support member and the other end extends obliquely downward to a direction of the lower purlin and is connected to the lower purlin; the support member, the upper force-guiding connecting beam and the lower force-guiding connecting beam jointly forms a triangular support structure; and a structural steel inner support beam and a prestress-pressing member in the foundation pit; wherein one end of the structural steel inner support beam abuts against a support component of the prestress-pressing member;

the prestress-pressing member comprises two mutually openable support parts; wherein one support part abuts on the support member of each of the vertical force-guiding connecting members; and the other support part is connected to an end portion of the structural steel inner support beam through bolts.

2. The structural steel inner support system in the foundation pit of claim 1, wherein an inclined angle of the upper force-guiding connecting beam is identical to an inclined angle of the lower force-guiding connecting beam.

3. The structural steel inner support system in the foundation pit of claim 1, wherein an inclined angle of the upper force-guiding connecting beam is greater than an inclined angle of the lower force-guiding connecting beam.

4. The structural steel inner support system in the foundation pit of claim 1, wherein the upper force-guiding connecting beam comprises a plurality of upper H beams arranged side by side and a plurality of upper connecting beams connecting the upper H beams; and the upper H beams are parallel to each other; and one of the upper connecting beams is perpendicular to one of the upper H beams.

5. The structural steel inner support system in the foundation pit according to claim 1, wherein the lower force-guiding connecting beam comprises a plurality of lower H beams arranged side by side and lower connecting beams connecting the lower H beams, and the lower H beams are parallel to each other, and one of the lower connecting beams is perpendicular to one of the lower H beams.

6. The structural steel inner support system in the foundation pit of claim 1, wherein a vertical connecting shaft rod is arranged between the upper force-guiding connecting beam and the lower force-guiding connecting beam.

* * * * *